US010096279B2

(12) United States Patent
Lee et al.

(10) Patent No.: US 10,096,279 B2
(45) Date of Patent: Oct. 9, 2018

(54) DISPLAY DEVICE HAVING A PLURALITY OF SUB-DISPLAY AREAS COMPRISING A PLURALITY OF SHARED REGIONS

(71) Applicant: SAMSUNG DISPLAY CO., LTD., Yongin-si, Gyeonggi-do (KR)

(72) Inventors: Kyungsu Lee, Ansan-si (KR); Jinpil Kim, Suwon-si (KR); Jung-won Kim, Seoul (KR); Sungjae Park, Wonju-si (KR); Namjae Lim, Gwacheon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 140 days.

(21) Appl. No.: 15/204,806

(22) Filed: Jul. 7, 2016

(65) Prior Publication Data

US 2017/0186359 A1 Jun. 29, 2017

(30) Foreign Application Priority Data

Dec. 24, 2015 (KR) ..... 10-2015-0186482

(51) Int. Cl.
*G09G 3/20* (2006.01)

(52) U.S. Cl.
CPC ..... *G09G 3/2092* (2013.01); *G09G 3/2003* (2013.01); *G09G 3/2074* (2013.01); *G09G 2320/0233* (2013.01)

(58) Field of Classification Search
CPC ..... G09G 2300/02; G06F 3/1446
See application file for complete search history.

(56) References Cited

U.S. PATENT DOCUMENTS 6,466,268 B1 * 10/2002 Kato ..... G09G 1/20 348/383
2004/0080479 A1 4/2004 Credelle
2005/0225574 A1 10/2005 Brown Elliott et al.
2007/0052887 A1 3/2007 Brown Elliot et al.
2008/0297541 A1 12/2008 Credelle
(Continued)

FOREIGN PATENT DOCUMENTS

KR 10-1073044 B1 10/2011
KR 10-1095635 B1 12/2011
KR 10-2015-0041459 A 4/2015

*Primary Examiner* — Sepehr Azari
(74) *Attorney, Agent, or Firm* — Lewis Roca Rothgerber Christie LLP

(57) ABSTRACT

A display device includes a display panel having first and second areas adjacent to each other, and a distribution unit configured to generate first and second input image data from primitive image data. The display device includes a first control unit having a first sub-pixel rendering unit configured to receive the first input image data and to generate first rendering data by performing sub-pixel rendering on the first input image data. The display device further includes a second control unit having a second sub-pixel rendering unit configured to receive the second input image data and to generate second rendering data by performing sub-pixel rendering on the second input image data. The display device includes an extraction unit configured to extract from the first rendering data, first output data corresponding to the first area, and from the second rendering data, second output data corresponding to the second area.

18 Claims, 12 Drawing Sheets

(56) References Cited

U.S. PATENT DOCUMENTS

2011/0148908 A1* 6/2011 Jeong ..... G09G 5/02
345/590
2013/0322753 A1* 12/2013 Lim ..... G06T 5/001
382/167

* cited by examiner

DISPLAY DEVICE HAVING A PLURALITY OF SUB-DISPLAY AREAS COMPRISING A PLURALITY OF SHARED REGIONS

CROSS-REFERENCE TO RELATED APPLICATION

This U.S. non-provisional patent application claims priority to and the benefit of Korean Patent Application No. 10-2015-0186482, filed on Dec. 24, 2015, the entire content of which is hereby incorporated by reference.

BACKGROUND

The present disclosure herein relates to a display device having excellent image quality.

In general, a display panel displays color using the three primary colors of red, green, and blue. Therefore, the display panel is provided with red, green, and blue sub-pixels for respectively displaying red, green, and blue. A recently developed display panel is further provided with a white sub-pixel for increasing luminance of a display image.

A technology for providing each of two pixels with two different sub-pixels among red, green, blue, and white sub-pixels is being developed to replace a typical technology for providing each of two pixels with red, green, and blue sub-pixels.

A display device to which such a technology is applied renders input image data in order to compensate for resolution degradation due to reduction of the number of sub-pixels. Accordingly, the input image data including red, green, and blue input image signals may be converted into image data including red, green, blue, and white pixel data so as to improve luminance of a displayed image.

SUMMARY

Aspects of embodiments of the present disclosure are directed toward a display device having excellent image quality.

An embodiment of the inventive concept provides a display device that includes a display panel having first and second areas adjacent to each other. The display device further includes a distribution unit (or distributor) configured to generate first and second input image data from primitive image data. The first input image data includes first primitive image data corresponding to the first area and first shared primitive data corresponding to a first shared area of the second area. The second input image data includes second primitive image data corresponding to the second area and second shared primitive data corresponding to a second shared area of the first area. The display device also includes a first control unit (or first controller) that has a first sub-pixel rendering unit (or first sub-pixel renderer) configured to receive the first input image data and to perform sub-pixel rendering on the first input image data to generate first rendering data. The display device further includes a second control unit (or second controller) that has a second sub-pixel rendering unit (or second sub-pixel renderer) configured to receive the second input image data and to perform sub-pixel rendering on the second input image data to generate second rendering data. The display device also includes an extraction unit (or extractor) configured to extract from the first rendering data, first output data corresponding to the first area, and from the second rendering data, second output data corresponding to the second area.

In an embodiment, the display device may further include a first data driver configured to convert the first output data into a first data voltage and output the first data voltage to a first data line in the first area. The display device may further include a second data driver configured to convert the second output data into a second data voltage and output the second data voltage to a second data line in the second area.

In an embodiment, the first and second shared areas may contact each other.

In an embodiment, the display panel may include a plurality of data lines arranged with each other in a first direction and extending in a second direction that crosses (e.g., intersects with) with the first direction, and a boundary between the first and second shared areas may extend (i.e., the boundary line may be) substantially parallel with the second direction.

In an embodiment, the distribution unit may be configured to receive first and second sub separation signals, to generate the first input image data by extracting data corresponding to a first separation period of the first sub separation signal from the primitive image data, and to generate the second input image data by extracting data corresponding to a second separation period of the second sub separation signal from the primitive image data.

In an embodiment, the first and second separation periods may temporally overlap with each other during a period in which the first and second shared primitive data are provided.

In an embodiment, the extraction unit may be configured to receive an extraction signal and to extract from the first rendering data, as the first output data, data corresponding to a first extraction period of a first sub extraction signal of the extraction signal.

In an embodiment, the first rendering data may include the first output data and first shared output data corresponding to the first shared area, and the first extraction period may be maintained during a period in which the first output data is provided.

In an embodiment, the first and second sub-pixel rendering units may be configured to respectively receive the first and second input image data, and to generate red, green, blue, and white rendering data of the first and second rendering data on the basis of the first and second input image data using a re-sampling filter.

In an embodiment, ith row-jth column pixel data of the first and second rendering data may be generated on the basis of values determined by applying the re-sampling filter to the ith row-jth column pixel data of the first and second input image data.

In an embodiment, a row-directional width of the first shared area may correspond to l number of pixels, and the re-sampling filter may have k number of blocks corresponding to k number of pixels arranged in a row direction from a center block, where l may be equal to or greater than k.

In an embodiment, when ith row-jth column pixel data of the first and second rendering data include blue rendering data, ith row-jth column blue rendering data of the first and second rendering data may be determined by applying the re-sampling filter to the ith row-(j±1)th column pixel data of the first and second input image data.

In an embodiment, when the ith row-jth column pixel data of the first and second rendering data does not comprise blue rendering data, ith row-jth column pixel data of the first and second rendering data may be determined by applying the re-sampling filter to ith row-jth column pixel data of the first and second input image data.

In an embodiment, the display device may further include a third control unit (or third controller) having a third sub-pixel rendering unit configured to generate third rendering data by performing sub-pixel rendering on third input image data. The display panel may further include a third area adjacent to the second area. The second input image data may include third shared primitive data corresponding to a third shared area of the third area. The primitive image data may include third input image data that includes third primitive image data corresponding to the third area and fourth shared primitive data corresponding to a fourth shared area of the second area.

In an embodiment, the extraction unit may be configured to extract third output data corresponding to the third area from the third rendering data.

In an embodiment, the third and fourth shared areas may contact each other.

In an embodiment, the display panel may include a plurality of data lines arranged with each other in a first direction and extending in a second direction that crosses (e.g., intersects with) with the first direction, and a boundary between the third and fourth shared areas may extend (i.e., the boundary line may be) substantially parallel with the second direction.

In an embodiment, the first to fourth shared areas and the second area may be sequentially arranged in the first direction in order of the second shared area, the first shared area, the second area, the fourth shared area, and the third shared area.

In an embodiment, the first and second control units may be included in separate chips.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
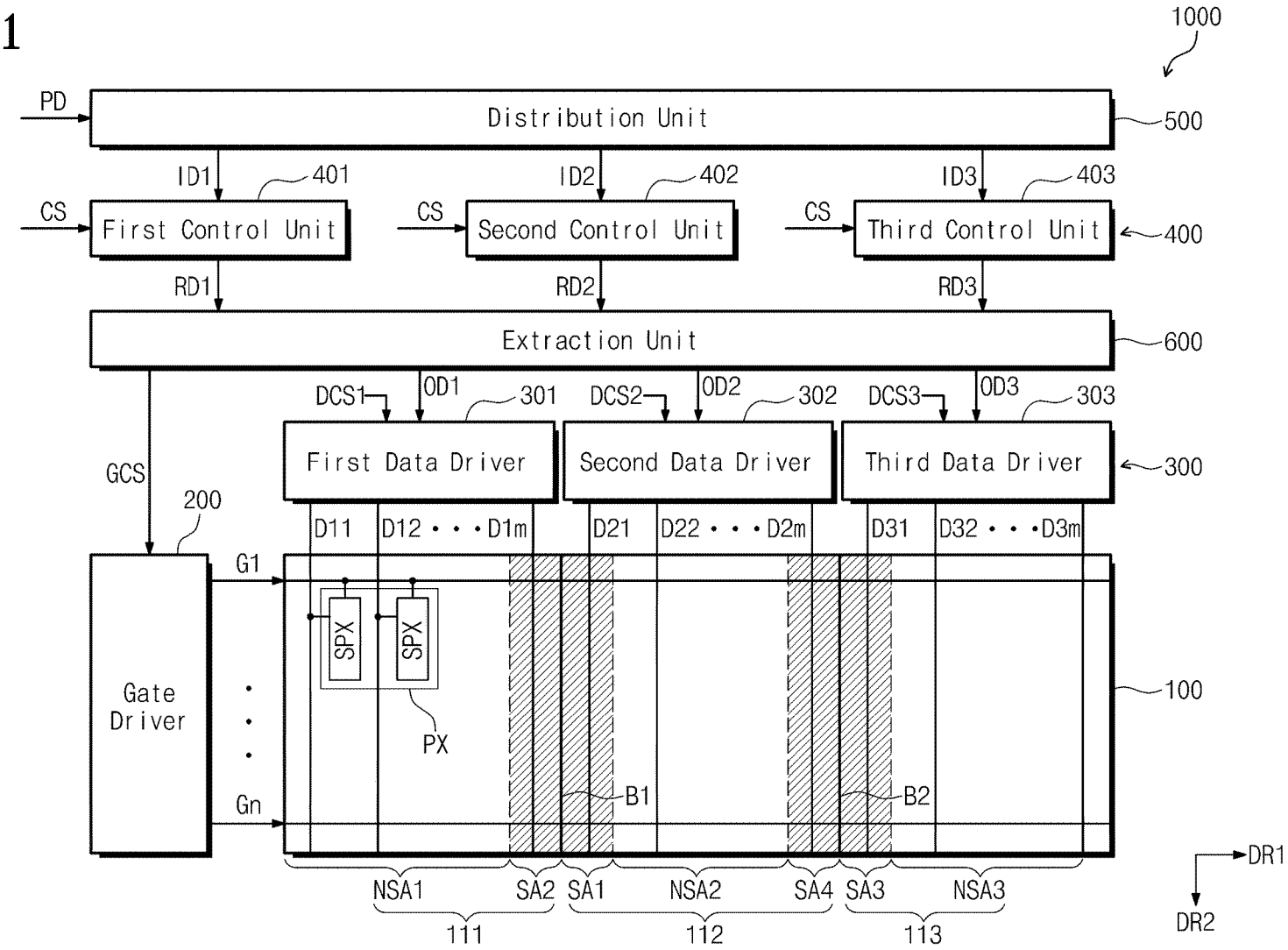
FIG. 1 is a schematic block diagram illustrating a display device according to an embodiment of the inventive concept.

The present disclosure may be variously modified and may include various modes. However, particular embodiments are exemplarily illustrated in the drawings and are described in detail below. However, it should be understood that the present disclosure is not limited to specific forms, but rather cover all modifications, equivalents or alternatives that fall within the spirit and scope of the present disclosure. The embodiments herein are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described.

Unless otherwise noted, like reference numbers refer to like elements throughout the attached drawings and the written description, and thus, descriptions thereof will not be repeated. In the accompanying drawings, the dimensions of structures are exaggerated for clarity of illustration. It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. For example, a first element, component, region, layer or section could be termed a second element, component, region, layer or section and vice versa without departing from the teachings of the present disclosure. As used herein, the singular forms are intended to include the plural forms as well, unless the context clearly indicates otherwise.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

The terminology used herein is for the purpose of describing particular embodiments only and is not intended to limit the present invention. It will be further understood that the terms "comprises," "comprising," "includes", "including", "has", "having", and the like, when used in this specification, specify the presence of stated features, integers, steps, operations, elements, and/or components, but do not preclude the presence or addition of one or more other features, integers, steps, operations, elements, components, and/or groups thereof. As used herein, the singular forms "a" and "an" are intended to include the plural forms as well, unless the context clearly indicates otherwise. As used herein, the term "and/or" includes any and all combinations of one or more of the associated listed items. Expressions such as "at least one of," when preceding a list of elements, modify the entire list of elements and do not modify the individual elements of the list.

It will be further understood that when a part such as a layer, a film, an area, a plate, or the like is referred to as being "on," "connected to," or "coupled to" another part, it can be directly on, connected to, or coupled to the other part or intervening parts may be present. Likewise, when a part such as a layer, a film, an area, a plate, or the like is referred to as being "under" another part, it can be directly under the other part or intervening parts may be present. In addition, it will also be understood that when an element or layer is referred to as being "between" two elements or layers, it can be the only element or layer between the two elements or layers, or one or more intervening elements or layers may also be present.

As used herein, the term "substantially," "about," and similar terms are used as terms of approximation and not as terms of degree, and are intended to account for the inherent deviations in measured or determined values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g., an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Exemplary embodiments of the inventive concept will be described below in more detail with reference to the accompanying drawings.

FIG. 1 is a schematic block diagram illustrating a display device according to an embodiment of the inventive concept.

Referring to FIG. 1, a display device 1000 according to an embodiment of the inventive concept includes a display panel 100 for displaying an image, a gate driver 200 and a data driver 300 for driving the display panel 100, a control unit (or controller) 400 for controlling operation of the gate driver 200 and the data driver 300, a distribution unit (or distributor) 500 for distributing data to the control unit 400, and an extraction unit (or extractor) 600.

The control unit 400 may be provided as a plurality of control units (or controllers) in order to distributively process a large amount of image data. In an example embodiment of the inventive concept, the control unit 400 may be provided as three control units including first to third control units 401 to 403. The first to third control units 401 to 403 may be included in separate and/or different chips. That is, the control unit 400 may be implemented with a multi-chip.

In an example embodiment of the inventive concept, the display panel 100 may include a first to third areas 111 to 113. The first to third areas 111 to 113 may be sequentially arranged with each other in a first direction DR1. The display panel 100 may be divided into three parts in the first direction DR1 due to the first to third areas 111 to 113.

The display panel 100 may display an image through the first to third areas 111 to 113. The first to third areas 111 to 113 may display images corresponding to image data processed in the first to third control units 401 to 403, respectively. In other words, the first area 111 may display an image corresponding to image data processed in first control unit 401. The second area 112 may display an image corresponding to image data processed in second control unit 402. The third area 113 may display an image corresponding to image data processed in third control unit 403.

The display panel 100 includes gate lines G1 to Gn, data lines, and sub-pixels SPX. The gate lines G1 to Gn, for example, extend in the first direction DR1 and are arranged with each other in a second direction DR2. The first and second directions DR1 and DR2 may cross (e.g., be perpendicular to) each other. In some embodiments, the first and second directions DR1 and DR2 may not cross (e.g., be perpendicular to) one another.

The data lines insulatively intersect with the gate lines G1 to Gn. For example, the data lines may extend in the second direction DR2 and may be arranged in the first direction DR1.

In an example embodiment of the inventive concept, the data lines may include a plurality of first data lines D11 to D1*m* arranged in the first area 111, a plurality of second data lines D21 to D2*m* arranged in the second area 112, and a plurality of third data lines D31 to D3*m* arranged in the third area 113.

As shown in the example embodiment of FIG. 1, each sub-pixel SPX is connected to a corresponding gate line among the gate lines G1 to Gn and a corresponding data line among the data lines (e.g., data line D11).

The sub-pixels SPX may be arranged in a matrix along the first and second directions DR1 and DR2. Each of the sub-pixels SPX may present one of a primary color, such as red, green, or blue. Color presentable by the sub-pixels SPX is not limited to red, green, and blue. Rather, each of the sub-pixels SPX may also present various colors such as secondary primary colors (such as yellow, cyan, magenta, or any other suitable secondary primary color) in addition to red, green, and blue.

The sub-pixels SPX may constitute a pixel PX. In an example embodiment of the inventive concept, two sub-pixels SPX may constitute one pixel PX. However, an embodiment of the inventive concept is not limited thereto, and two or more sub-pixels SPX may constitute one pixel PX.

The pixel PX is an element for displaying a unit image, and a resolution of the display panel 100 may be determined according to the number of pixels PX provided to the display panel 100. Although FIG. 1 illustrates only one pixel PX and the other pixels are not illustrated, persons of ordinary skill in the art will readily recognize and appreciate that embodiments may include a plurality of pixels PX.

The distribution unit 500 may receive primitive image data PD. In an example embodiment of the inventive concept, the primitive image data PD may be provided from the outside (e.g., from a data source external to and/or separate from display device 1000), and may include image information about an image to be displayed on the display panel 100.

In an example embodiment of the inventive concept, the distribution unit 500 may divide the primitive image data PD into a plurality of input image data, and may distribute the plurality of input image data to the first to third control units 401 to 403. For example, as illustrated in the embodiment of FIG. 1, the distribution unit 500 generates first to third input image data ID1 to ID3 from the primitive image data PD, and distributes the first to third input image data ID1 to ID3 to the first to third control units 401 to 403, respectively.

The first control unit 401 receives the first input image data ID1 and a plurality of control signals CS. The first control unit 401 generates first rendering data RD1 by processing the first input image data ID1 so that the first input image data ID1 is compatible with an interface specification of the data driver 300, and outputs the first rendering data RD1 to the extraction unit 600.

Furthermore, the first control unit 401 generates a data control signal DCS1 (e.g., an output initiation signal, a horizontal initiation signal, etc.) and a gate control signal GCS (e.g., a vertical initiation signal, a vertical clock signal, a vertical clock bar signal, etc.) on the basis of the plurality of control signals CS. The data control signal DCS1 is provided to a first data driver 301 of the data driver 300, and the gate control signal GCS is provided to the gate driver 200.

The second control unit 402 receives the second input image data ID2 and the plurality of control signals CS. The second control unit 402 generates second rendering data RD2 by processing the second input image data ID2 so that the second input image data ID2 is compatible with the interface specification of the data driver 300, and outputs the second rendering data RD2 to the extraction unit 600.

The second control unit 402 generates a data control signal DCS2 on the basis of the plurality of control signals CS. The data control signal DCS2 is provided to a second data driver 302 of the data driver 300.

The third control unit 403 receives the third input image data ID3 and the plurality of control signals CS. The third control unit 403 generates third rendering data RD3 by processing the third input image data ID3 so that the third input image data ID3 is compatible with the interface specification of the data driver 300, and outputs the third rendering data RD3 to the extraction unit 600.

The third control unit 403 generates a data control signal DCS3 on the basis of the plurality of control signals CS. The data control signal DCS3 is provided to a third data driver 303 of the data driver 300.

The extraction unit 600 receives the first to third rendering data RD1 to RD3. In an example embodiment of the inventive concept, the extraction unit 600 may extract, from the first to third rendering data RD1 to RD3, first to third output data OD1 to OD3 corresponding to the first to third areas 111 to 113, respectively.

The gate driver 200 sequentially outputs the gate signals G1 to Gn in response to the gate control signal GCS provided from the first control unit 401.

The first data driver 301 converts the first output data OD1 into one or more first data voltages in response to the data control signal DCS1 provided from the first control unit 401, and outputs the one or more first data voltages to the plurality of first data lines D11 to D1*m*.

The second data driver 302 converts the second output data OD2 into one or more second data voltages in response to the data control signal DCS2 provided from the second control unit 402, and outputs the one or more second data voltages to the plurality of second data lines D21 to D2*m*.

The third data driver 303 converts the third output data OD3 into one or more third data voltages in response to the data control signal DCS3 provided from the third control unit 403, and outputs the one or more third data voltages to the plurality of third data lines D31 to D3*m*.

Herein, it is assumed that the display panel 100 includes three areas, i.e., the first to third areas 111 to 113. However, an embodiment of the inventive concept is not limited thereto, and may also be applied to the case where the display panel 100 is divided into less than three areas (e.g., two areas) or more than three areas (e.g., four or more areas).

Figure 2:
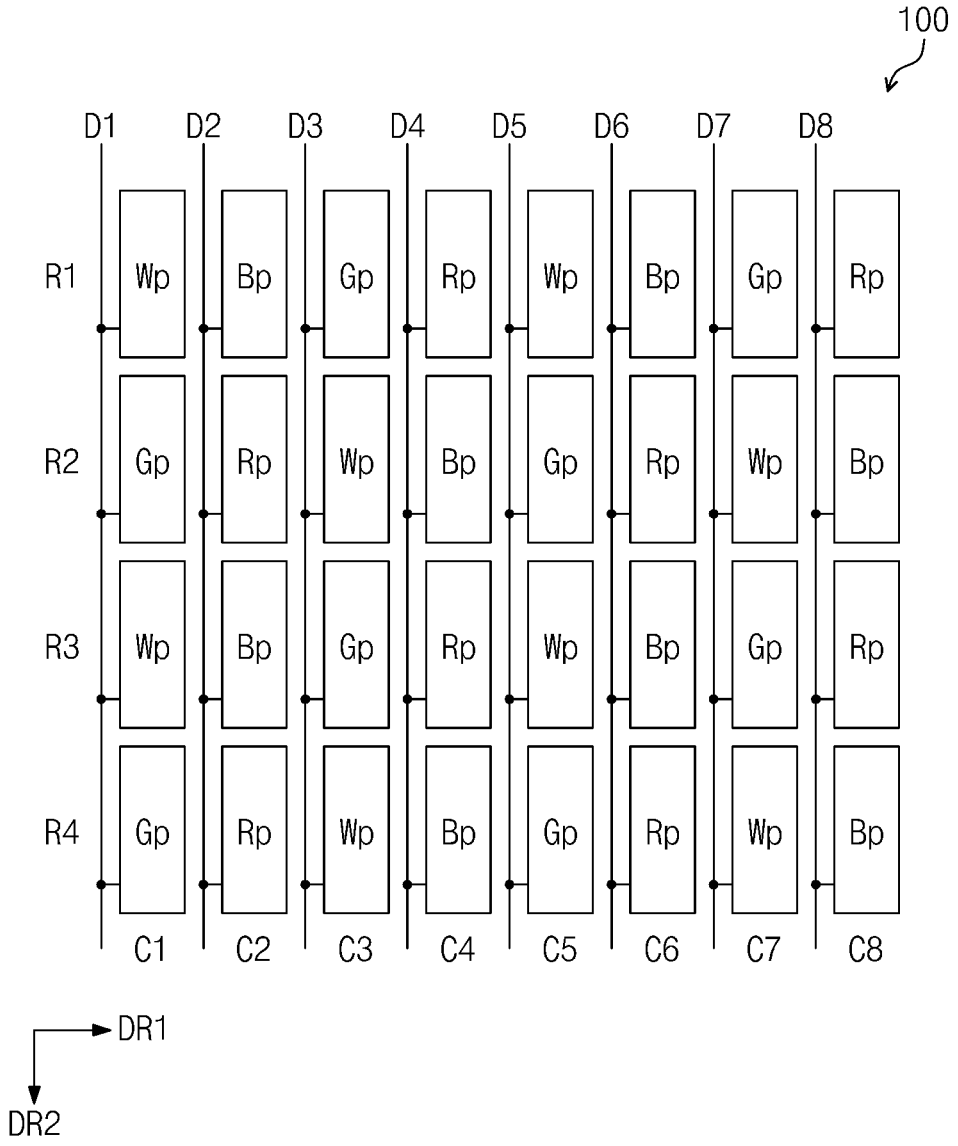
FIG. 2 is a planar view of a part of the display panel illustrated in FIG. 1.

FIG. 2 is a planar view of a part of the display panel 100 illustrated in FIG. 1.

As an example embodiment of the inventive concept, FIG. 2 illustrates the pixel PX of FIG. 1 connected to eight data lines D1 to D8. For convenience, a red sub-pixel is indicated by Rp, a green sub-pixel is indicated by Gp, a blue sub-pixel is indicated by Bp, and a white sub-pixel is indicated by Wp in FIG. 2.

Referring to FIG. 2, the display panel 100 includes a plurality of red sub-pixels Rp for presenting red (e.g., red light), a plurality of green sub-pixels Gp for presenting green (e.g., green light), a plurality of blue sub-pixels Bp for presenting blue (e.g., blue light), and a plurality of white sub-pixels Wp for presenting white (e.g., white light).

A set of pixels sequentially arranged with each other in the first direction DR1, from among the sub-pixels SPX, may be defined as a pixel row, and a set of pixels sequentially arranged with each other in the second direction DR2, from among the sub-pixels, may be defined as a pixel column. The display panel 100 may be provided with a plurality of pixel rows and a plurality of pixel columns. FIG. 2 illustrates first to eighth columns C1 to C8 from among the plurality of pixel columns and first to fourth rows R1 to R4 from among the plurality of pixel rows.

In an odd-numbered pixel row, the white sub-pixel Wp, the blue sub-pixel Bp, the green sub-pixel Gp, and the red sub-pixel Rp may be arranged sequentially and/or repeatedly. In an even-numbered pixel row, the green sub-pixel Gp, and the red sub-pixel Rp, the white sub-pixel Wp, and the blue sub-pixel Bp may be arranged sequentially and/or repeatedly.

Figure 3:
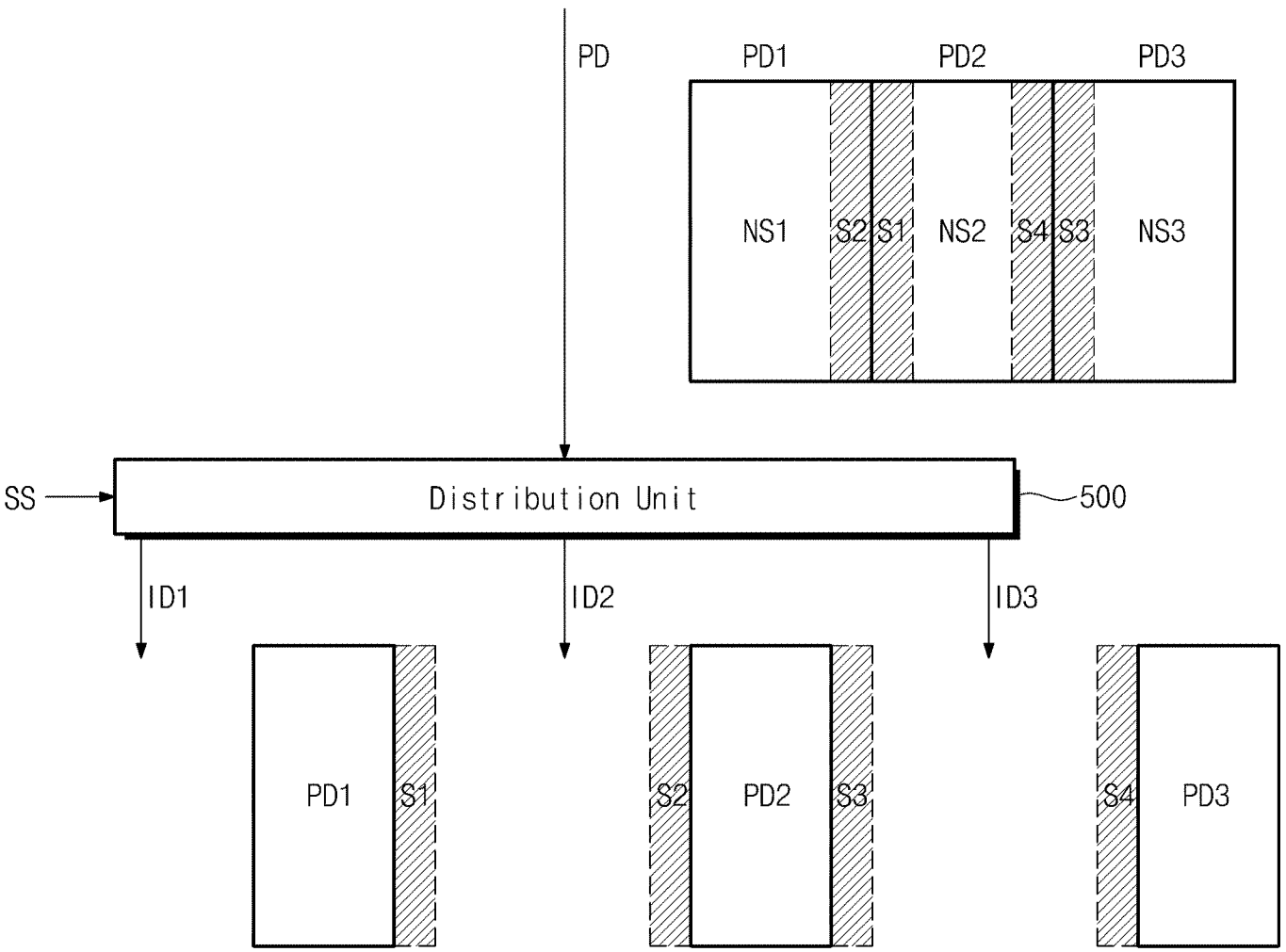
FIG. 3 is a block diagram illustrating the distribution unit of FIG. 1.

FIG. 3 is a block diagram illustrating the distribution unit 500 of FIG. 1.

Referring to FIGS. 1 and 3, the distribution unit 500 receives a separation signal SS, and divides the primitive image data PD into the first to third input image data ID1 to ID3 based on (e.g., in response to) the separation signal SS.

In an example embodiment of the inventive concept (e.g., as illustrated in FIG. 1), a first boundary line B1 may be defined between the first and second areas 111 and 112, and a second boundary line B2 may be defined between the second and third areas 112 and 113. In an example embodiment of the inventive concept, the first and second boundary lines B1 and B2 may be substantially parallel with the second direction DR2. In an example embodiment, the first and second boundary lines B1 and B2 may have orientations that are not substantially parallel to one another (e.g., at an angle with respect to one another).

In an example embodiment of the inventive concept, the first area 111 may include a first non-shared area NSA1 and a second shared area SA2. A boundary line between the first non-shared area NSA1 and the second shared area SA1 (e.g., as illustrated in FIG. 1 by a broken line) may be substantially parallel with the second direction DR2.

Similar to the first area 111, the second area 112 may include a second non-shared area NSA2 and first and fourth shared areas SA1 and SA4, and the third area 113 may include a third non-shared area NSA3 and a third shared area SA3.

The first and second shared areas SA1 and SA2 may contact each other. The boundary between the first and second shared areas SA1 and SA2 may be the first boundary line B1. The third and fourth shared areas SA3 and SA4 may contact each other. The boundary between the third and fourth shared areas SA3 and SA4 may be the second boundary line B2.

In an example embodiment of the inventive concept, each of the first to fourth shared areas SA1 to SA4 may include one pixel column. However, an embodiment of the inventive concept is not limited thereto, and each of the first to fourth shared areas SA1 to SA4 may be defined to include two or more pixel columns. In an example embodiment of the inventive concept, the number of pixel columns included in each of the first to fourth shared areas SA1 to SA4 may be determined by a size (e.g., a row-directional width) of a re-sampling filter described below.

The primitive image data PD may be divided into first to third primitive image data PD1 to PD3 corresponding to the first to third areas 111 to 113, respectively. The first to third primitive image data PD1 to PD3 may include pieces of image information about images to be displayed on the first to third areas 111 to 113, respectively.

For efficiently describing a correspondence relationship between the first to third areas 111 to 113 and the first to third primitive image data PD1 to PD3, FIG. 3 spatially illustrates the foregoing elements so that the first to third primitive image data PD1 to PD3 correspond to the first to third areas 111 to 113. (x, y) coordinates of the primitive image data PD illustrated in FIG. 3 may indicate pixel data to be displayed by a pixel of the (x, y) coordinates of the display panel 100.

The first primitive image data PD1 includes first non-shared primitive data NS1 and second shared primitive data S2 respectively corresponding to the first non-shared area NSA1 and the second shared area SA2.

Likewise, the second primitive image data PD2 includes second non-shared primitive data NS2 and first and fourth shared primitive data S1 and S4 respectively corresponding to the second non-shared area NSA2 and the first and fourth shared areas SA1 and SA4.

Furthermore, the third primitive image data PD3 includes third non-shared primitive data NS3 and third shared primitive data S3 respectively corresponding to the third non-shared area NSA3 and the third shared area SA3.

The distribution unit 500 extracts the first primitive image data PD1 and the first shared primitive data S1 from the primitive image data PD on the basis of the separation signal SS, and outputs the extracted first primitive image data PD1 and first shared primitive data S1 as the first input image data ID1. Because the first shared primitive data S1 corresponds to the first shared area SA1 of the second area 112, the first input image data ID1 may have information on an image to be displayed on the first shared area SA1.

Likewise, the distribution unit 500 extracts the second primitive image data PD2 and the second and third shared primitive data S2 and S3 from the primitive image data PD on the basis of the separation signal SS, and outputs the extracted second primitive image data PD2 and second and third shared primitive data S2 and S3 as the second input image data ID2. Because the second and third shared primitive data S2 and S3 respectively correspond to the second shared area SA2 of the first area 111 and the third shared area SA3 of the third area 113, the second input image data ID2 may have information on images to be displayed on the second and third shared areas SA2 and SA3.

Likewise, the distribution unit 500 extracts the third primitive image data PD3 and the fourth shared primitive data S4 from the primitive image data PD on the basis of the separation signal SS, and outputs the extracted third primitive image data PD3 and fourth shared primitive data S4 as the third input image data ID3. Because the fourth shared primitive data S4 corresponds to the fourth shared area SA4 of the second area 112, the third input image data ID3 may have information on an image to be displayed on the fourth shared area SA4.

Figure 4:
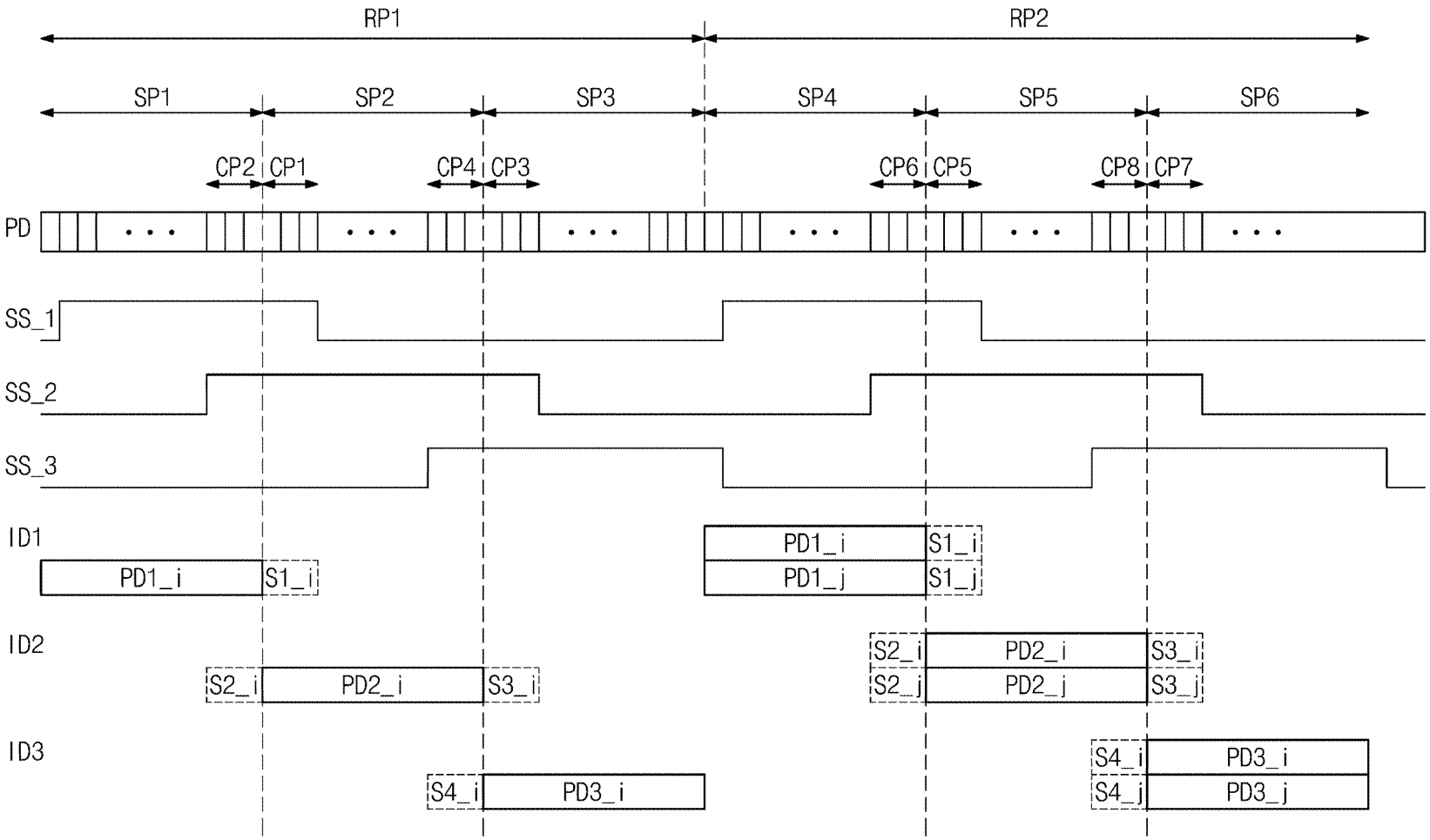
FIG. 4 is a schematic timing diagram illustrating operation of the distribution unit of FIG. 3.

FIG. 4 is a schematic timing diagram illustrating operation of the distribution unit 500 of FIG. 3.

The operation of the distribution unit 500 is described below with reference to FIGS. 3 and 4. The pixel data of the primitive image data PD, for example, are temporally supplied to the distribution unit 500 in a serial manner.

In an example embodiment of the inventive concept, the pixel data are serially arranged for each pixel row. The pixel data corresponding to an ith pixel row of the display panel 100 (illustrated in FIG. 1) may be arranged during a first row period RP1, and, thereafter, the pixel data corresponding to an (i+1)th pixel row of the display panel 100 may be arranged during a second row period RP2.

A plurality of first to third sub row periods SP1 to SP3 may be defined in the first row period RP1. The first to third sub row periods SP1 to SP3 are periods in which the pixel data of the first to third primitive image data PD1 to PD3 corresponding to the ith pixel row are provided. First to fourth shared periods CP1 to CP4 are periods in which the pixel data of the first to fourth shared primitive data S1 to S4 corresponding to the ith pixel row are provided.

Likewise, fourth to sixth sub row periods SP4 to SP6 and fifth to eighth shared periods CP5 to CP8 may be defined in the second row period RP2. In the fourth to sixth sub row periods SP4 to SP6 and fifth to eighth shared periods CP5 to CP8, the pixel data corresponding to a jth pixel row are provided.

In an example embodiment of the inventive concept, the distribution unit 500 may extract, as the first input image data ID1, the primitive image data PD corresponding to a first separation period of a first sub separation signal SS_1 of the separation signal SS in the first row period RP1. The pixel data extracted in the first row period RP1 may be the first primitive image data PD1_*i* and the first shared primitive data S1_*i* corresponding to the ith pixel row.

The first separation period may be defined as a period in which a high level of the first sub separation signal SS_1 is maintained. In an example embodiment of the inventive concept, the first separation period may be determined to correspond to the first sub row period SP1 and the first shared period CP1 in the first row period RP1.

Likewise, the distribution unit 500 may extract, as the second input image data ID2, the primitive image data PD corresponding to a second separation period of a second sub separation signal SS_2 of the separation signal SS in the first row period RP1. The pixel data extracted in the first row period RP1 may be the second primitive image data PD2_*i* and the second and third shared primitive data S2_*i* and S3_*i* corresponding to the ith pixel row.

The second separation period may be defined as a period in which a high level of the second sub separation signal SS_2 is maintained. In an example embodiment of the inventive concept, the second separation period may be determined to correspond to the second sub row period SP2 and the second and third shared periods CP2 and CP3 in the first row period RP1.

The first and second separation periods may temporally overlap with each other (e.g., partially overlap with each other) during the first and second shared periods CP1 and CP2 in which the first and second shared primitive data S1 and S2 are provided.

Likewise, the distribution unit 500 may extract, as the third input image data ID3, the primitive image data PD corresponding to a third separation period of a third sub separation signal SS_3 of the separation signal SS in the first row period RP1. The pixel data extracted in the first row period RP1 may be the third primitive image data PD3_*i* and the fourth shared primitive data S4_*i* corresponding to the ith pixel row.

The third separation period may be defined as a period in which a high level of the third sub separation signal SS_3 is maintained. In an example embodiment of the inventive concept, the third separation period may be determined to correspond to the third sub row period SP3 and the fourth shared period CP4 in the first row period RP1.

The second and third separation periods may temporally overlap with each other (e.g., partially overlap with each other) during the third and fourth shared periods CP3 and CP4 in which the third and fourth shared primitive data S3 and S4 are provided.

As a result, the primitive image data PD corresponding to the ith pixel row may be divided into the first to third input image data ID1 to ID3 during the first row period RP1. Likewise, the primitive image data PD corresponding to the jth pixel row may be divided into the first to third input image data ID1 to ID3 during the second row period RP2.

In an example embodiment of the inventive concept, the distribution unit 500 may extract, as the first input image data ID1, the primitive image data PD corresponding to the first separation period of the first sub separation signal SS_1 in the second row period RP2. The pixel data extracted in the second row period RP2 may be the first primitive image data PD1_*j* and the first shared primitive data S1_*j* corresponding to the jth pixel row.

In an example embodiment of the inventive concept, the first separation period may be determined to correspond to the fourth sub row period SP4 and the fifth shared period CP5 in the second row period RP2.

Likewise, the distribution unit 500 may extract, as the second input image data ID2, the primitive image data PD corresponding to the second separation period of the second sub separation signal SS_2 in the second row period RP2. The pixel data extracted in the second row period RP2 may be the second primitive image data PD2_*j* and the second and third shared primitive data S2_*j* and S3_*j* corresponding to the jth pixel row.

In an example embodiment of the inventive concept, the second separation period may be determined to correspond to the fifth sub row period SP5 and the sixth and seventh shared periods CP6 and CP7 in the second row period RP2.

Likewise, the distribution unit 500 may extract, as the third input image data ID3, the primitive image data PD corresponding to the third separation period of the third sub separation signal SS_3 in the second row period RP2. The pixel data extracted in the second row period RP2 may be the third primitive image data PD3_*j* and the fourth shared primitive data S4_*j* corresponding to the jth pixel row.

In an example embodiment of the inventive concept, the third separation period may be determined to correspond to the sixth sub row period SP6 and the eighth shared period CP8 in the second row period RP2.

In this manner, for all pixel rows, the first to third input image data ID1 to ID3 may be generated using the first to third sub separation signals SS_1 to SS_3, respectively.

In an example embodiment of the inventive concept, the distribution unit 500 may efficiently separate the first to third input image data ID1 to ID3 using the separation periods of the separation signal SS.

Figure 5:
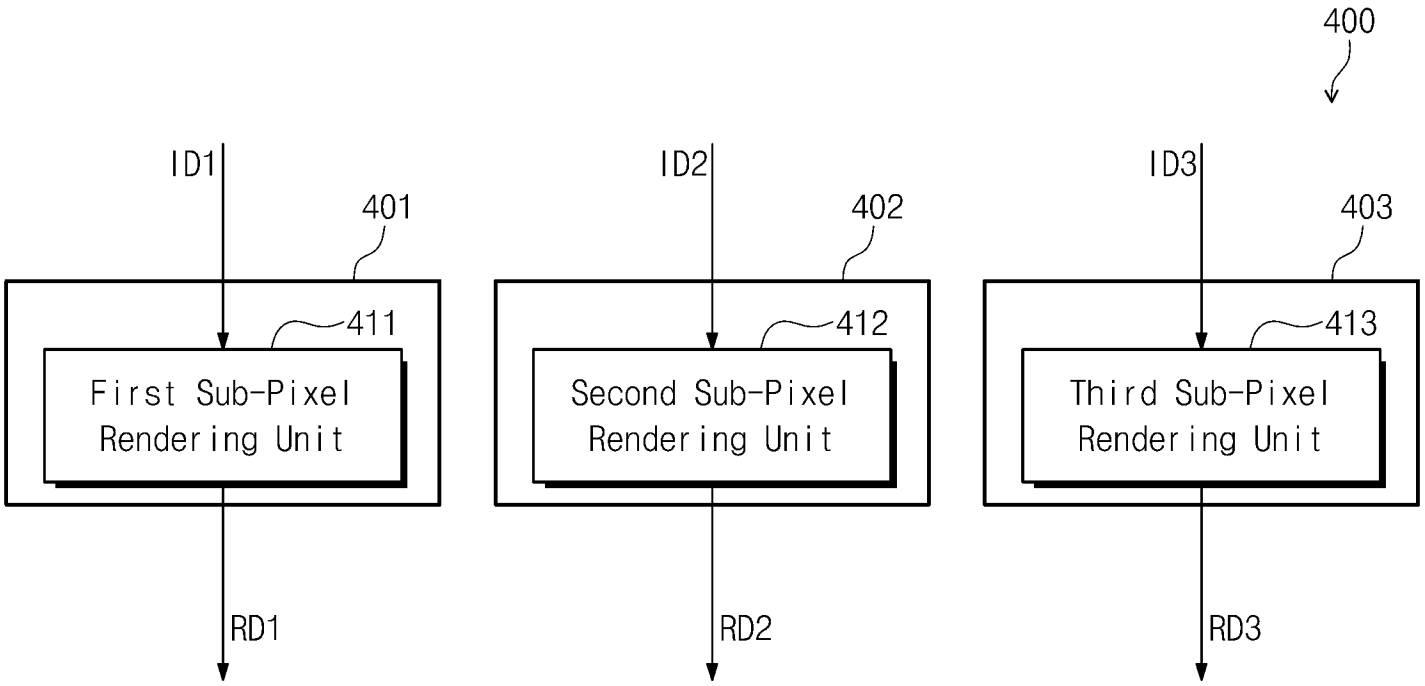
FIG. 5 is a block diagram illustrating the control unit of FIG. 1.

FIG. 5 is a block diagram illustrating the control unit 400 of FIG. 1.

Referring to FIG. 5, the first to third control units 401 to 403 include first to third sub pixel rendering units (or first to third sub pixel renderers) 411 to 413, respectively.

The first to third sub pixel rendering units 411 to 413 may respectively receive the first to third input image data ID1 to ID3 and may perform sub-pixel rendering on the first to third input image data ID1 to ID3 to respectively generate the first to third rendering data RD1 to RD3.

The first to third sub pixel rendering units 411 to 413 may perform a common operation, such as the common operation described below using the first sub pixel rendering unit 411 with reference to FIG. 6.

Figure 6:
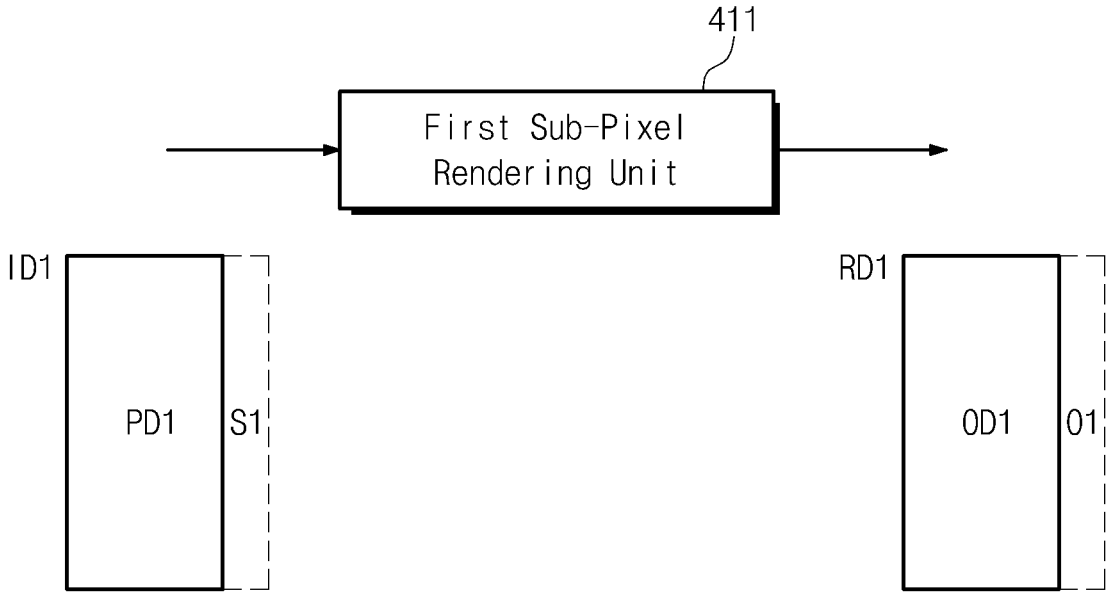
FIG. 6 is a block diagram illustrating the first sub-pixel rendering unit of FIG. 5.

FIG. 6 is a block diagram illustrating the first sub pixel rendering unit 411 of FIG. 5.

Referring to FIG. 6, the first sub pixel rendering unit 411 performs a rendering operation on the first input image data ID1 to generate the first rendering data RD1. The rendering operation to be performed in the first sub pixel rendering unit 411 may include a re-sample filtering operation and/or a sharp filtering operation.

Figure 7A:
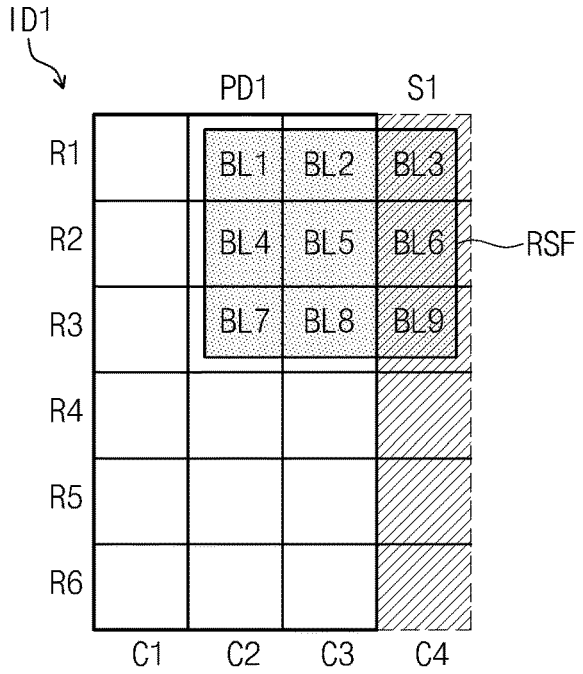
FIGS. 7A and 7B are diagrams illustrating a re-sample filtering operation of the first sub-pixel rendering unit of FIG. 6.
Figure 7B:
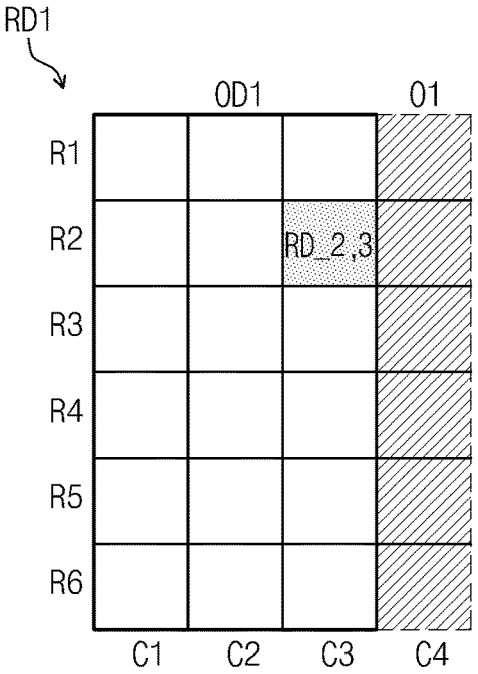

The re-sample filtering operation may be performed using a re-sampling filter RSF (illustrated in FIGS. 7A and 7B). The re-sample filtering operation may generate data corresponding to a target pixel on the basis of pixel data corresponding to the target pixel and pixels adjacent thereto among the first input image data ID1.

Furthermore, the first sub pixel rendering unit 411 may compensate the first rendering data RD1 through the sharp filtering operation after the re-sample filtering operation is performed. The first rendering data RD1 may be compensated by performing the sharp filtering operation so that lines, edges, points, diagonal lines, and the like of the first input image data ID1 are distinguished so as to be displayed appropriately.

In an example embodiment of the inventive concept, the first rendering data RD1 includes first output data OD1 and first shared output data O1. The first output data OD1 and the first shared output data O1 may be generated by rendering the first primitive image data PD1 and the first shared primitive data S1, respectively. The first rendering data may include red, green, blue, and/or white rendering data. The red, green, blue, and/or white rendering data may include information on red, green, blue, and/or white images, respectively.

The first control unit 401 may include a gamma mapping unit (or gamma mapper) at a front of the first sub pixel rendering unit 411 in an example embodiment of the inventive concept. The gamma mapping unit may receive the first input image data ID1, and may map the first input image data ID1 so as to output the first input image data ID1 mapped to the first sub pixel rendering unit 411. The gamma mapping unit may map a red/green/blue (RGB) gamut of the first input image data ID1 to a red/green/blue/white (RGBW) gamut using a gamut mapping algorithm (GMA). The gamma mapping unit may further generate luminance data of the first input image data ID1. The luminance data may be provided to the first sub pixel rendering unit 411, and may be used for the sharp filtering operation.

In an example embodiment of the inventive concept, the first control unit 401 may be further provided with an input gamma conversion unit (or gamma converter) at a front of the gamma mapping unit. The input gamma conversion unit adjusts a gamma characteristic of the first input image data ID1 and outputs the first input image data ID1 of which the gamma characteristic has been adjusted so as to facilitate data processing performed in the gamma mapping unit and the first sub pixel rendering unit 411. The input gamma conversion unit linearizes and outputs the first input image data ID1 so that a nonlinear gamma characteristic of the first input image data ID1 is proportional to luminance.

An output gamma conversion unit may be further provided at a rear of the first sub pixel rendering unit 411. The output gamma conversion unit performs inverse gamma correction on the first rendering data RD1 so as to linearize and output the first rendering data RD1.

FIGS. 7A and 7B are diagrams illustrating a re-sample filtering operation of the first sub pixel rendering unit 411 of FIG. 6.

Referring to FIGS. 7A and 7B, in an example embodiment of the inventive concept, the re-sampling filter RSF includes first to ninth blocks BL1 to BL9 arranged in a 3-by-3 matrix. The first to ninth blocks BL1 to BL9 have scale factors. A sum of the scale factors of the first to ninth blocks BL1 to BL9 may be, for example, 1. In an example embodiment of the inventive concept, 0, 0.125, 0, 0.125, 0.5, 0.125, 0, 0.125, and 0 are respectively set as the scale factors of the first to ninth blocks BL1 to BL9. In an example embodiment, first to ninth blocks BL1 to BL9 may have or be characterized by other suitable scale factors.

In an example embodiment of the inventive concept, the first primitive image data PD1 may include pixel data arranged in a 6-by-3 matrix. The first primitive image data PD1 may include, for example, three pixel columns defined in first to third columns C1 to C3. In an example embodiment of the inventive concept, the first shared primitive data S1 may include pixel data arranged in a 6-by-1 matrix. The first shared primitive data S1 may include one pixel column defined in a fourth column C4.

In an example embodiment of the inventive concept, ith row-jth column pixel data of the first rendering data RD1 corresponding to an ith row-jth column pixel may be determined by applying the re-sampling filter RSF to ith row-jth column pixel data of the first input image data ID1. The fifth block BL5, which in the example embodiment illustrated in FIG. 7A is a center block of the re-sampling filter RSF, may be matched to the ith row-jth column pixel data of the first input image data ID1.

For example, pixel data RD_2,3 of the second row R2 and the third column C3 of the first rendering data RD1 may be generated by applying the re-sampling filter RSF to the pixel data of the second row R2 and the third column C3 of the first input image data ID1. As the re-sampling filter RSF is applied to the pixel data of the second row R2 and the third column C3 of the first input image data ID1, the factors of the first to ninth blocks BL1 to BL9 are multiplied by corresponding pixel data values of the first input image data ID1. The values multiplied by the factors of the first to ninth blocks BL1 to BL9 may be summed so as to be generated as a value of the pixel data RD_2,3 of the second row R2 and the third column C3 of the first rendering data RD1.

For example, the third, fifth, and ninth blocks BL3, BL5, and BL9 may be multiplied by values of the pixel data of the first row R1 and the fourth column C4, the second row R2 and the fourth column C4, and the third row R3 and the fourth column C4.

As a result, the value of the pixel data RD_2,3 of the first rendering data RD1 may be prevented from being distorted and image quality may be improved, because values of the first shared primitive data S1 may be applied when sub pixel rendering is performed to generate the pixel data RD_2,3 of the second row R2 and the third column C3 of the first rendering data RD1.

Referring back to FIG. 1, when the first control unit 401 performs sub-pixel rendering with respect to pixel data corresponding to pixels (e.g., pixels of the second shared area SA2) adjacent to the first boundary line B1 among the pixels of the first area 111, the first control unit 401 may generate data on the basis of pixel data corresponding to the first shared area SA1 of the second area 112. As a result, an image displayed on the first boundary line B1 may be prevented from being distorted or degraded in terms of image quality.

Although the above description is provided on the assumption that the first shared primitive data S1 has one pixel column, the first shared primitive data S1 may have two or more pixel columns according to a pixel structure, a driving method of the display panel 100, or other design features in order to prevent image distortion in the first shared area SA1.

For example, the re-sampling filter RSF may be provided with k number of blocks corresponding to k number of pixels in a row direction from the center block, and a row-directional width of the first shared area SA1 may correspond to l number of pixels. l may be equal to or greater than k.

Figure 8A:
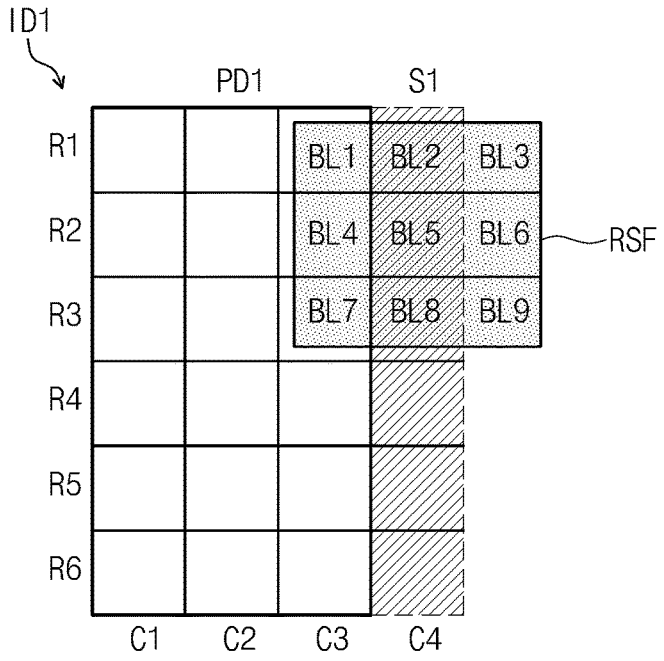
FIGS. 8A and 8B are diagrams illustrating a blue shift operation of the first sub-pixel rendering unit of FIG. 6.
Figure 8B:
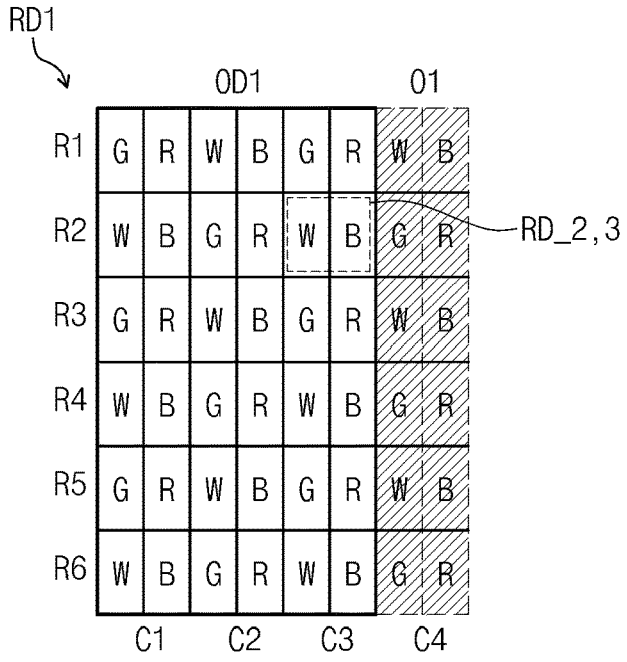

FIGS. 8A and 8B are diagrams illustrating a blue shift operation of the first sub pixel rendering unit 411 of FIG. 6.

In an example embodiment of the inventive concept, the blue shift operation may be performed. The blue shift operation may include an operation of calculating ith row-jth column blue rendering data of the first rendering data RD1 by applying the re-sampling filter RSF to ith row-jth column pixel data of the first input image data ID1 in the case where ith row-(j±1)th column pixel data of the first rendering data RD1 includes blue rendering data. An example embodiment of the inventive concept in which the re-sampling filter RSF is applied to ith row-(j+1)th column pixel data of the first input image data ID1 is described below.

For example, in the case where the pixel data RD_2,3 of the second row R2 and the third column C3 includes blue rendering data B, the blue rendering data B may be generated by applying the re-sampling filter RSF to the pixel data of the second row R2 and the fourth column C4 of the first input image data ID1. As the re-sampling filter RSF is applied to the pixel data of the second row R2 and the fourth column C4 of the first input image data ID1, the factors of the first, second, fourth, fifth, seventh, and eighth blocks BL1, BL2, BL4, BL5, BL7, and BL8 are multiplied by corresponding pixel data values of the first input image data ID1.

As a result, because a blue shift algorithm for generating the blue rendering data B of the pixel data RD_2,3 is applicable, degradation of a white pattern may be prevented through the blue shift algorithm.

Referring back to FIG. 1, when the first control unit 401 performs sub-pixel rendering with respect to pixel data corresponding to blue sub-pixels (e.g., pixels of the second shared area S2) adjacent to the first boundary line B1 among the pixels of the first area 111, the first control unit 401 may generate data by applying the blue shift algorithm to pixel data corresponding to the first shared area SA1 of the second area 112. As a result, a white pattern (e.g., a white dot pattern or a white line pattern parallel with the second direction DR2) on the first boundary line B1 may be prevented from being degraded.

Figure 9:
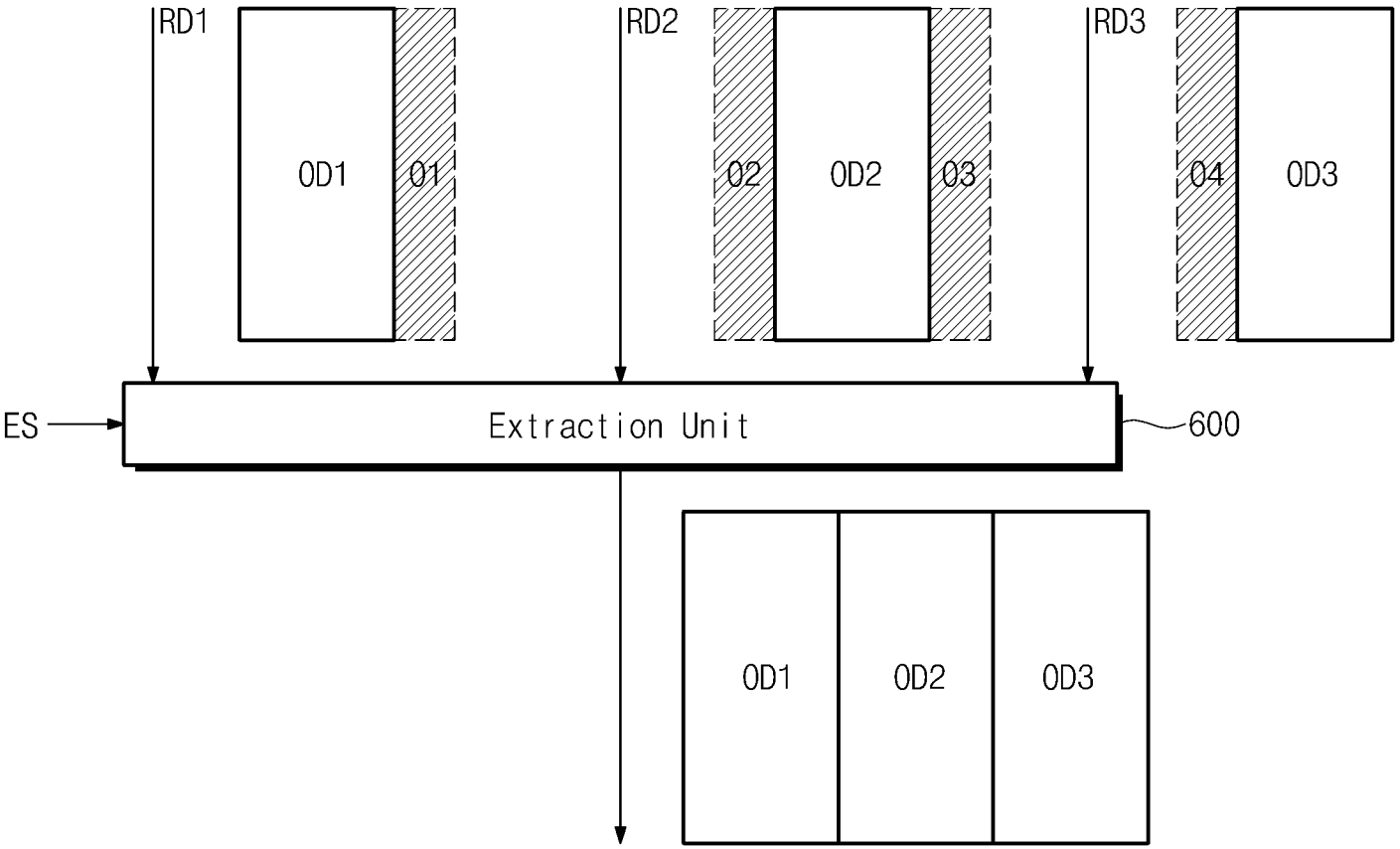
FIG. 9 is a block diagram illustrating the extraction unit of FIG. 1.
Figure 10:
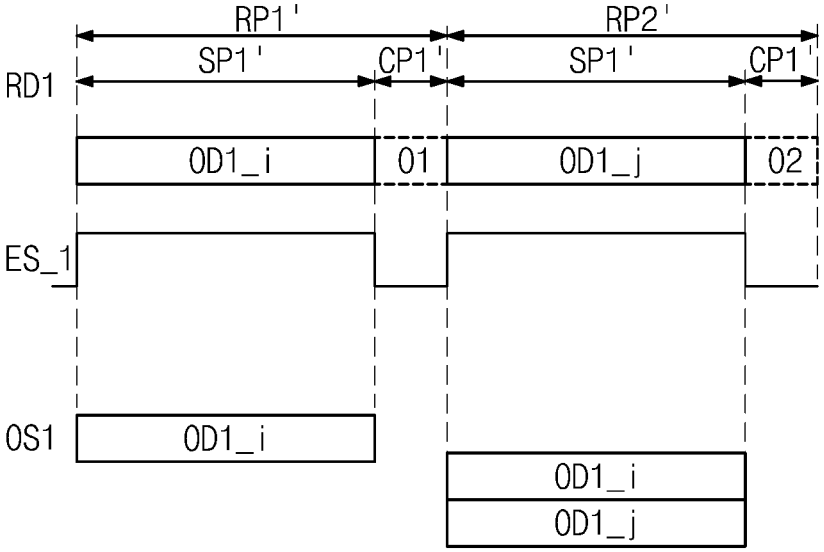
FIG. 10 is a timing diagram illustrating operation of the extraction unit illustrated in FIG. 9.
Figure 11A:
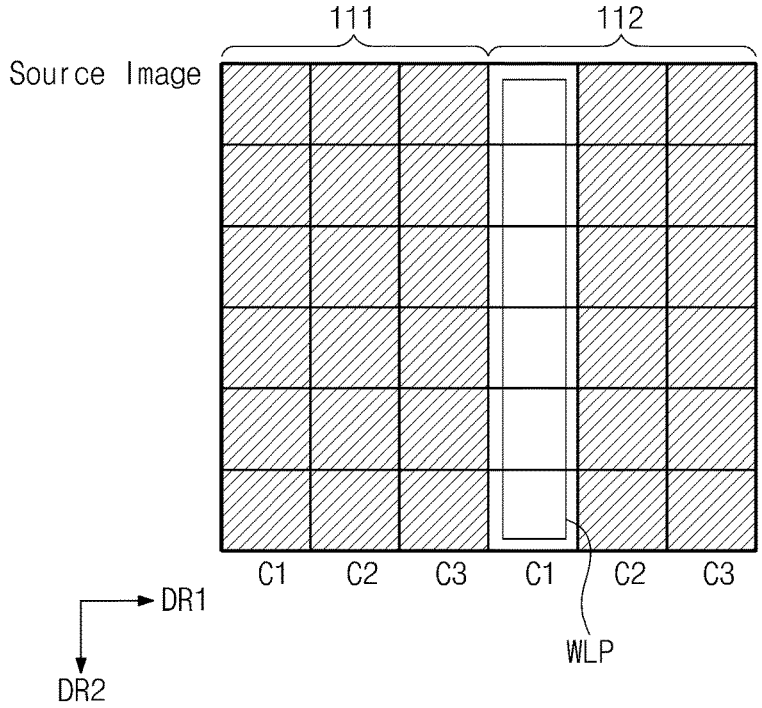
FIGS. 11A through 11D are diagrams illustrating an image processing method according to an embodiment of the inventive concept.
Figure 11B:
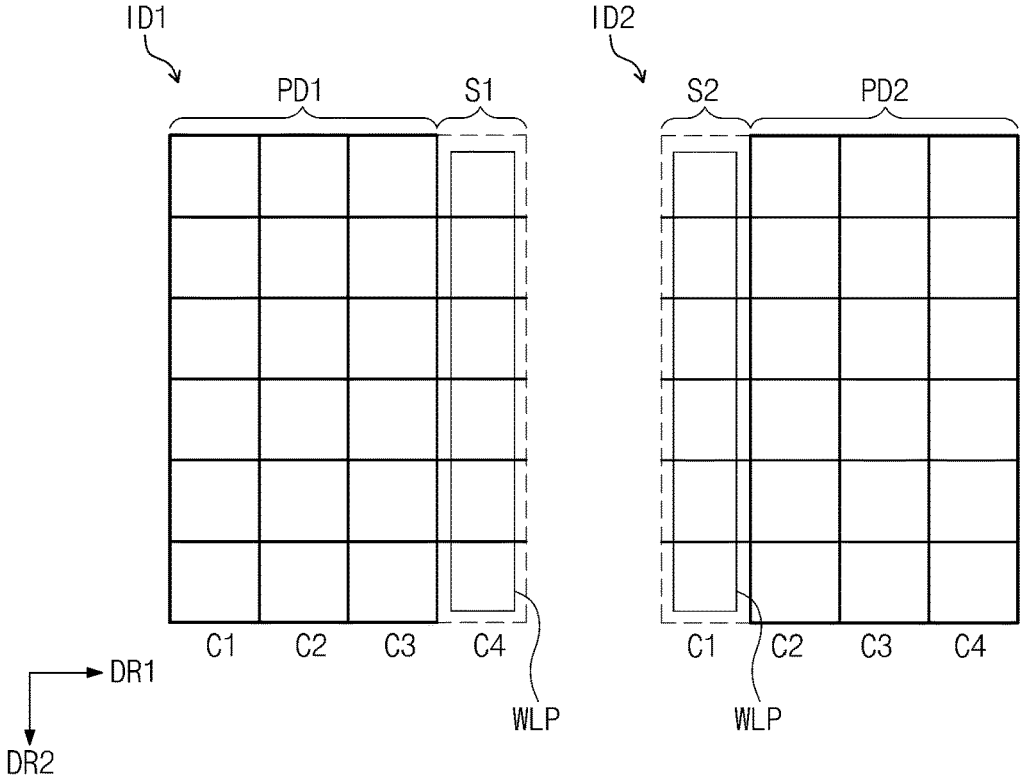
Figure 11C:
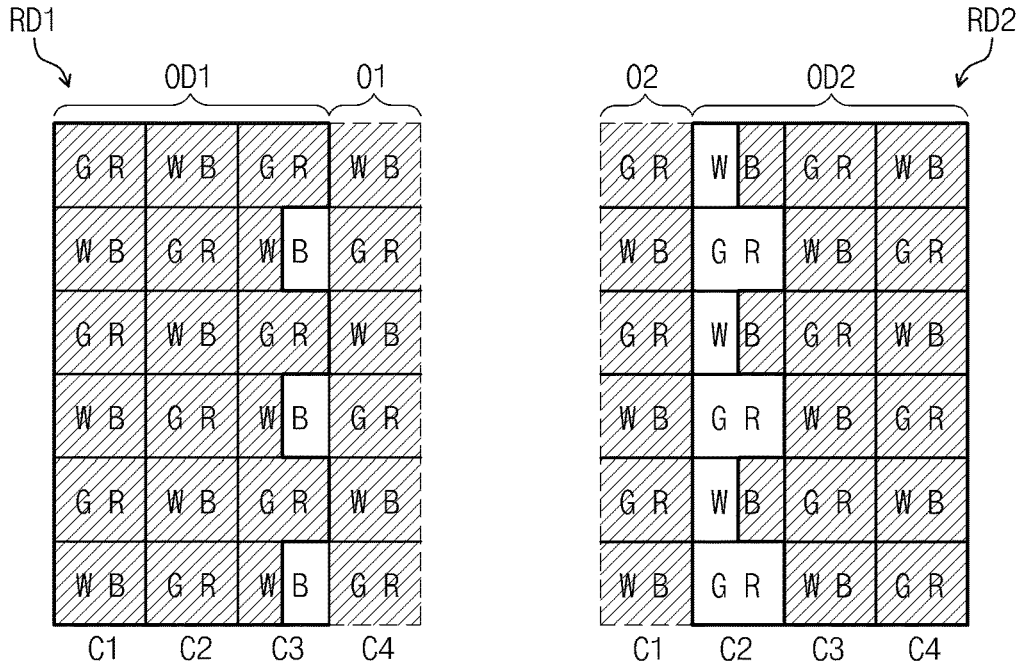
Figure 11D:
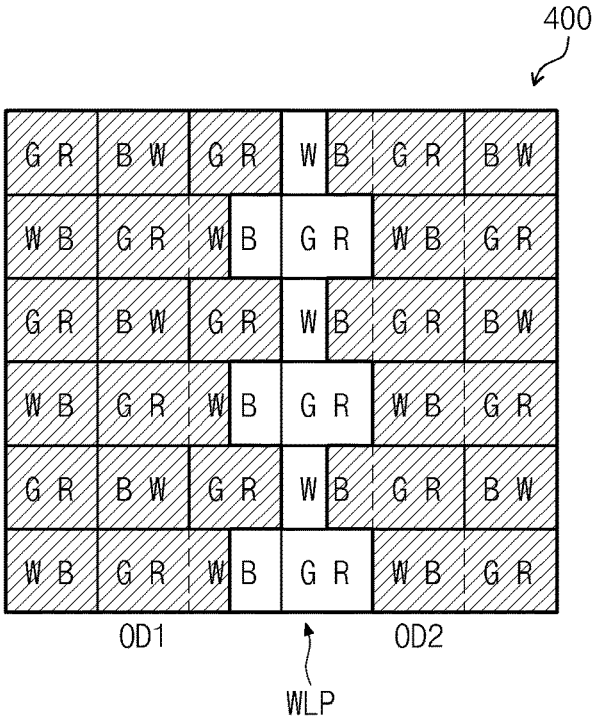

FIG. 9 is a block diagram illustrating the extraction unit 600 of FIG. 1, and FIG. 10 is a timing diagram illustrating operation of the extraction unit 600 of FIG. 9.

Referring to FIGS. 1 and 9, as described above, the first rendering data RD1 includes the first output data OD1 and the first shared output data O1 generated by rendering the first primitive image data PD1 and the first shared primitive data S1 (which are shown in FIG. 3), respectively. Likewise, the second rendering data RD2 includes second output data OD2 and second and third shared output data O2 and O3 generated by rendering the second primitive image data PD2 and the second and third shared primitive data S2 and S3 (which are shown in FIG. 3), respectively. Likewise, the third rendering data RD3 includes third output data OD3 and fourth shared output data O4 generated by rendering the third primitive image data PD3 and the fourth shared primitive data S4 (which are shown in FIG. 3), respectively.

In an example embodiment of the inventive concept, the extraction unit 600 may receive an extraction signal ES and may separate the first to fourth shared output data O1 to O4 from the first to third rendering data RD1 to RD3 in response to the extraction signal ES so as to extract the first to third output data OD1 to OD3.

Referring to FIG. 10, in an example embodiment of the inventive concept, the pixel data of the first rendering data RD1 are serially arranged for each pixel row. The pixel data corresponding to an ith pixel row of the display panel 100 may be arranged during a first row period RP1', and, thereafter, the pixel data corresponding to a jth pixel row of the display panel 100 may be arranged during a second row period RP2'.

A first sub row period SP1' and a first shared period CP1' may be defined in each of the first and second row periods RP1' and RP2'. The first sub row period SP1' is a period in which the pixel data of the first output data OD1 corresponding to the ith pixel row is provided. Furthermore, in the first shared period CP1', the pixel data of the first shared output data O1 corresponding to the ith pixel row is provided.

In the first row period RP1', the first output data OD1 of the first rendering data RD1 corresponding to a first extraction period defined by a first sub extraction signal ES_1 of the extraction signal ES may be extracted. The pixel data extracted in the first row period RP1' may be the first output data OD1_*i* corresponding to the ith pixel row. Accordingly, remaining pixel data not extracted in the first row period RP1' may be the first shared output data O1_*i* corresponding to the ith pixel row.

The first extraction period may be defined as a period in which a high level of the first sub extraction signal ES_1 is maintained. In an example embodiment of the inventive concept, the first extraction period may be determined to correspond to the first sub row period SP1'. That is, the first extraction period may be maintained during a period in which the first output data OD1_*i* is provided.

In the second row period RP2', the first output data OD1 of the first rendering data RD1 corresponding to a second extraction period defined by the first sub extraction signal ES_1 of the extraction signal ES may be extracted. The pixel data extracted in the second row period RP2' may be the first output data OD1_*j* corresponding to the jth pixel row. Accordingly, remaining pixel data not extracted in the second row period RP2' may be the first shared output data O1_*j* corresponding to the jth pixel row.

The extraction unit 600 may extract the second and third output data OD2 and OD3 from the second and third rendering data RD2 and RD3, respectively, in the same manner as that for extracting the first output data OD1.

To summarize the above description referring back to FIG. 1, the control unit 400 according to an example embodiment of the inventive concept includes the first to third control units 401 to 403 for performing sub-pixel rendering for images corresponding to the first to third areas 111 to 113 in order to distributively process a large amount of image data required for sub-pixel rendering. Because not only target pixel data but also pixel data of pixels adjacent to a target pixel may be used when sub-pixel rendering is performed, not only pixel data of an assigned area but also pixel data of adjacent shared areas may be received and provided to the first to third control unit 401 to 403 so that sub-pixel rendering may be performed on the basis of the received data. Accordingly, an image defect that may occur when sub-pixel rendering is distributively performed by the first to third control units 401 to 403 may be prevented. In particular, a defect (e.g., distortion of a vertical line) that may occur on adjacent areas to the first and second boundary line B1 and B2 may be efficiently prevented. As a result, the image quality of the display device 1000 may be improved.

Furthermore, the distribution unit 500 and the extraction unit 600 may efficiently separate and extract pixel data by simply controlling timings of high-level periods of the separation signal SS and the extraction signal ES. Therefore, structures and algorithms of the distribution unit 500 and the extraction unit 600 may be simplified.

FIGS. 11A to 11D are diagrams illustrating an image processing method according to an example embodiment of the inventive concept.

It will be described with reference to FIGS. 11A to 11D that a white line pattern is not distorted according to a blue shift in the case where pixel data is processed according to an example embodiment of the inventive concept.

As illustrated in FIGS. 11A to 11D, the second area 112 of a source image may include a white line pattern WLP extending in a direction substantially parallel to the second direction DR2. For example, the white line pattern WLP may be defined in the first column C1 of the second area 112. For convenience, the third area 113 (illustrated in FIG. 1) is not illustrated in FIGS. 11A to 11D.

The first shared primitive data S1 of the first input image data ID1 may include information on the white line pattern WLP. The blue rendering data B of the first rendering data RD1 may be determined by applying the re-sample filtering operation to the first shared primitive data S1 through the blue shift algorithm. A gradation value of blue corresponding to the white line pattern WLP is set in the blue rendering data B arranged in a third column of the first rendering data RD1.

Likewise, red, green, and white rendering data of the second rendering data RD2 may be determined by applying the re-sample filtering operation to the second shared primitive data S2 through the blue shift algorithm. Gradation values of white, red, and green corresponding to the white line pattern WLP are set in the red, green, and white rendering data R, G, and W arranged in a first column of the second rendering data RD2.

The first and second output data OD1 and OD2 are extracted from the first and second rendering data RD1 and RD2, respectively. As a result, the white line pattern WLP may be displayed on the display panel 100.

It has been exemplarily described that pixels display white, blue, green, and red in this order from left to right, and, when the blue shift operation is performed, the re-sampling filter RSF is applied to ith row-(j+1)th column pixel data of the first input image data ID1.

However, an embodiment of the inventive concept is not limited to the above description, and may be modified. For example, pixels may display red, green, blue, and white in this order from left to right, and, when the blue shift operation is performed, the re-sampling filter RSF may be applied to ith row-(j−1)th column pixel data of the first input image data ID1, so as to obtain a similar effect.

As described above and according to example embodiments, the first and second sub-pixel rendering unit perform sub-pixel rendering on the first and second input image data ID1 and ID2. The first input image data ID1 may include not only the first primitive image data PD1 corresponding to the first area 111 of the display panel 100 but also the first shared primitive data S1 corresponding to the first shared area SA1 of the second area 112 of the display panel 100. The second input image data ID2 may include not only the second primitive image data PD2 corresponding to the second area 112 but also the second shared primitive data S2 corresponding to the second shared area SA2 of the first area 111. Accordingly, in the case where sub-pixel rendering is performed on the first and second input image data ID1 and ID2, an image distortion that may occur at a boundary between the first and second areas 111 and 112 (e.g., boundary B1) may be prevented, thereby improving the image quality. Furthermore, the blue shift algorithm is applicable to an area adjacent to the boundary (e.g., boundary B1).

Although certain exemplary embodiments of the present invention have been illustrated and described, it is understood by those of ordinary skill in the art that the present invention should not be limited to these exemplary embodiments. Rather, various changes and modifications can be made to such embodiments by one of ordinary skilled in the art without departing from the spirit and scope of the present invention as defined by the following claims and equivalents thereof.

What is claimed is:

1. A display device, comprising:

a display panel having first and second areas adjacent to each other;

a distributor configured to generate first and second input image data from primitive image data, the first input image data comprising first primitive image data corresponding to the first area and first shared primitive data corresponding to a first shared area of the second area, the second input image data comprising second primitive image data corresponding to the second area and second shared primitive data corresponding to a second shared area of the first area;

a first controller having a first sub-pixel renderer configured to receive the first input image data and to perform sub-pixel rendering on the first input image data to generate first rendering data;

a second controller having a second sub-pixel renderer configured to receive the second input image data and to perform sub-pixel rendering on the second input image data to generate second rendering data; and an extractor configured to extract from the first rendering data, first output data corresponding to the first area, and from the second rendering data, second output data corresponding to the second area, wherein the distributor is configured to receive first and second sub separation signals, to generate the first input image data by extracting data corresponding to a first separation period of the first sub separation signal from the primitive image data, and to generate the second input image data by extracting data corresponding to a second separation period of the second sub separation signal from the primitive image data.

2. The display device of claim 1, further comprising:

a first data driver configured to convert the first output data into a first data voltage and output the first data voltage to a first data line in the first area; and a second data driver configured to convert the second output data into a second data voltage and output the second data voltage to a second data line in the second area.

3. The display device of claim 1, wherein the first and second shared areas contact each other.

4. The display device of claim 3, wherein the display panel comprises a plurality of data lines arranged with each other in a first direction and extending in a second direction crossing the first direction, and wherein a boundary between the first and second shared areas extends in a direction substantially parallel with the second direction.

5. The display device of claim 1, wherein the first and second separation periods temporally overlap with each other during a period in which the first and second shared primitive data are provided.

6. The display device of claim 1, wherein the extractor is configured to receive an extraction signal and to extract from the first rendering data, as the first output data, data corresponding to a first extraction period of a first sub extraction signal of the extraction signal.

7. The display device of claim 6, wherein the first rendering data comprises the first output data and first shared output data corresponding to the first shared area, and wherein the first extraction period is maintained during a period in which the first output data is provided.

8. The display device of claim 1, wherein the first and second sub-pixel renderers are configured to respectively receive the first and second input image data and to generate red, green, blue, and white rendering data of the first and second rendering data based on the first and second input image data utilizing a re-sampling filter.

9. The display device of claim 8, wherein ith row-jth column pixel data of the first and second rendering data are generated based on values determined by applying the re-sampling filter to the ith row-jth column pixel data of the first and second input image data.

10. The display device of claim 9, wherein a row-directional width of the first shared area corresponds to l number of pixels, and the re-sampling filter has k number of blocks corresponding to k number of pixels arranged in a row direction from a center block, where l is equal to or greater than k.

11. The display device of claim 8, wherein when ith row-jth column pixel data of the first and second rendering data comprise blue rendering data, ith row-jth column blue rendering data of the first and second rendering data are determined by applying the re-sampling filter to ith row-(j±1)th column pixel data of the first and second input image data.

12. The display device of claim 8, wherein when ith row-jth column pixel data of the first and second rendering data do not comprise blue rendering data, ith row-jth column pixel data of the first and second rendering data are determined by applying the re-sampling filter to ith row-jth column pixel data of the first and second input image data.

13. The display device of claim 1, further comprising:

a third controller having a third sub-pixel renderer configured to generate third rendering data by performing sub-pixel rendering on third input image data, wherein the display panel further comprises a third area adjacent to the second area, wherein the second input image data further comprises third shared primitive data corresponding to a third shared area of the third area, wherein the primitive image data further comprises third input image data comprising third primitive image data corresponding to the third area and fourth shared primitive data corresponding to a fourth shared area of the second area.

14. The display device of claim 13, wherein the extractor is configured to extract third output data corresponding to the third area from the third rendering data.

15. The display device of claim 13, wherein the third and fourth shared areas contact each other.

16. The display device of claim 15, wherein the display panel comprises a plurality of data lines arranged with each other in a first direction and extending in a second direction intersecting with the first direction, and wherein a boundary between the third and fourth shared areas extends in a direction substantially parallel with the second direction.

17. The display device of claim 16, wherein the first to fourth shared areas and the second area are sequentially arranged in the first direction in order of the second shared area, the first shared area, the second area, the fourth shared area, and the third shared area.

18. The display device of claim 1, wherein the first and second controllers are included in separate chips.

* * * * *